OR 3,947,835

7 2042C

United Sta

Laymon

[11] 3,947,835

[45] Mar. 30, 1976

[54] FENCE PROTECTION SYSTEM

[75] Inventor: Marvin D. Laymon, Milpitas, Calif.

[73] Assignee: GTE Sylvania Incorporated, Mountain View, Calif.

[22] Filed: July 1, 1974

[21] Appl. No.: 484,434

[52] U.S. Cl. ..... 340/261; 340/258 D
[51] Int. Cl.[2] ..... G08B 13/02
[58] Field of Search ..... 340/261, 258 D

[56] References Cited

UNITED STATES PATENTS

| | | | |
|---|---|---|---|
| 3,696,369 | 10/1972 | Laymon et al. | 340/258 D |
| 3,717,864 | 2/1973 | Cook et al. | 340/258 D |
| 3,750,127 | 7/1973 | Ayers et al. | 340/258 D |

*Primary Examiner*—David L. Trafton
*Attorney, Agent, or Firm*—John F. Lawler; Norman J. O'Malley; Elmer J. Nealon

[57] ABSTRACT

This fence protection system comprises an elongated electret cable for sensing vibrations on a fence and an electronic processing circuit connected to the cable for discriminating against spurious signals such as those caused by raindrops on the fence and nuisance signals produced by stick dragging on the fence. This circuit comprises a charge amplifier connected directly to the cable transducer and series connected burst width and interburst discriminators in conjunction with parallel connected pulse counter and integrator means feeding an alarm mechanism through an OR gate; signals produced by an intruder climbing or cutting the fence are distinguished from spurious raindrop and stick dragging signals and produce and alarm.

9 Claims, 4 Drawing Figures

FENCE PROTECTION SYSTEM

BACKGROUND OF THE INVENTION

This invention relates to intrusion detection systems and more particularly to a fence-type intrusion detection system using an electret cable.

The cable transducer described in U.S. Pat. No. 3,763,482 mounted on a chain link fence is responsive to vibrations in the fence to provide an output signal to processing circuits connected to the transducer. The system described in the foregoing patent has a voltage bandpass amplifier connected to the output of the cable transducer. The amplifier output is rectified and applied to a low pass filter or integrator and when the integrator output exceeds a preset threshold level, an alarm output is generated. Thus, one signal burst is capable of generating an alarm. False alarms from spurious signals can be reduced by increasing the threshold setting but this also reduces system sensitivity.

A signal generated by the electret cable in response to a mechanical stress of the outer conductor produces a minute change in capacitance and thus in electric charge over a small segment of the cable. The small change in charge thus produced must be distributed over the entire cable capacitance when the cable is terminated in a relatively high impedance such as the input to a voltage amplifier. Since cable capacitance is proportional to cable length, the amplifier voltage gain required to increase the signal level to a suitable value increases proportionally to cable length. The maximum length of cable that can be used with each processor is therefore dependent upon the maximum gain available from the amplifier. Furthermore, selection of different lengths of cable at the installation site requires time consuming field adjustments of the voltage amplifier to properly change its gain as required by the cable length selected.

Another problem experienced with the system described in the foregoing patent is difficulty in discriminating against the particular types of false alarm conditions to which the electret cable protected fence may be subjected in a normal environment. Raindrops impacting on the fence can produce signals that result in a false alarm. Another source of false alarm signals is the dragging of a stick along the fence. It is very desirable that the electret cable-equipped fence be capable of better discriminating against such false alarm signals in order that the utility of the system may be broadened.

OBJECTS AND SUMMARY OF INVENTION

A general object of the invention is the provision of a processor for fence protection system utilizing an electret cable sensor in which the sensitivity of the signal processor is substantially independent of the length of the sensor line.

An ancillary object is the provision of such a signal processor which may be used with different lengths of electret cable without readjustment.

A further object is the provision of an electret cable fence protection system with a processor capable of discriminating against signals produced by raindrops and by stick dragging along the fence.

Still another object is the provision of such a processor which is capable of discriminating against signals generated by stick dragging against the fence while minimizing the effectiveness of such dragging for intentionally masking signals produced by an intruder.

These and other objects of the invention are achieved with a processor having a low input impedance amplifier connected to the output of the coaxial electret sensor cable. Such an amplifier, called a charge amplifier, is particularly responsive to the charge on the cable (including the rate of charge, i.e., current) which parameter is theoretically independent of cable length, thus providing maximum signal detection per unit length of cable. The processor counts only signal bursts having widths greater than a predetermined minimum thereby to discriminate against characteristically narrow width raindrop signals and does not count bursts having less than a predetermined interburst spacing so as to discriminate against signals produced by stick dragging. An alarm is activated after a selected number of counts occur within a predetermined interval. A timing circuit detects continuous (non-pulse) signals that persist beyond a time less than that normally required to effect an intrusion and generates an alarm when the condition occurs to prevent masking of an attempted instrusion by stick dragging.

DESCRIPTION OF PREFERRED EMBODIMENT

Figures 1, 2:
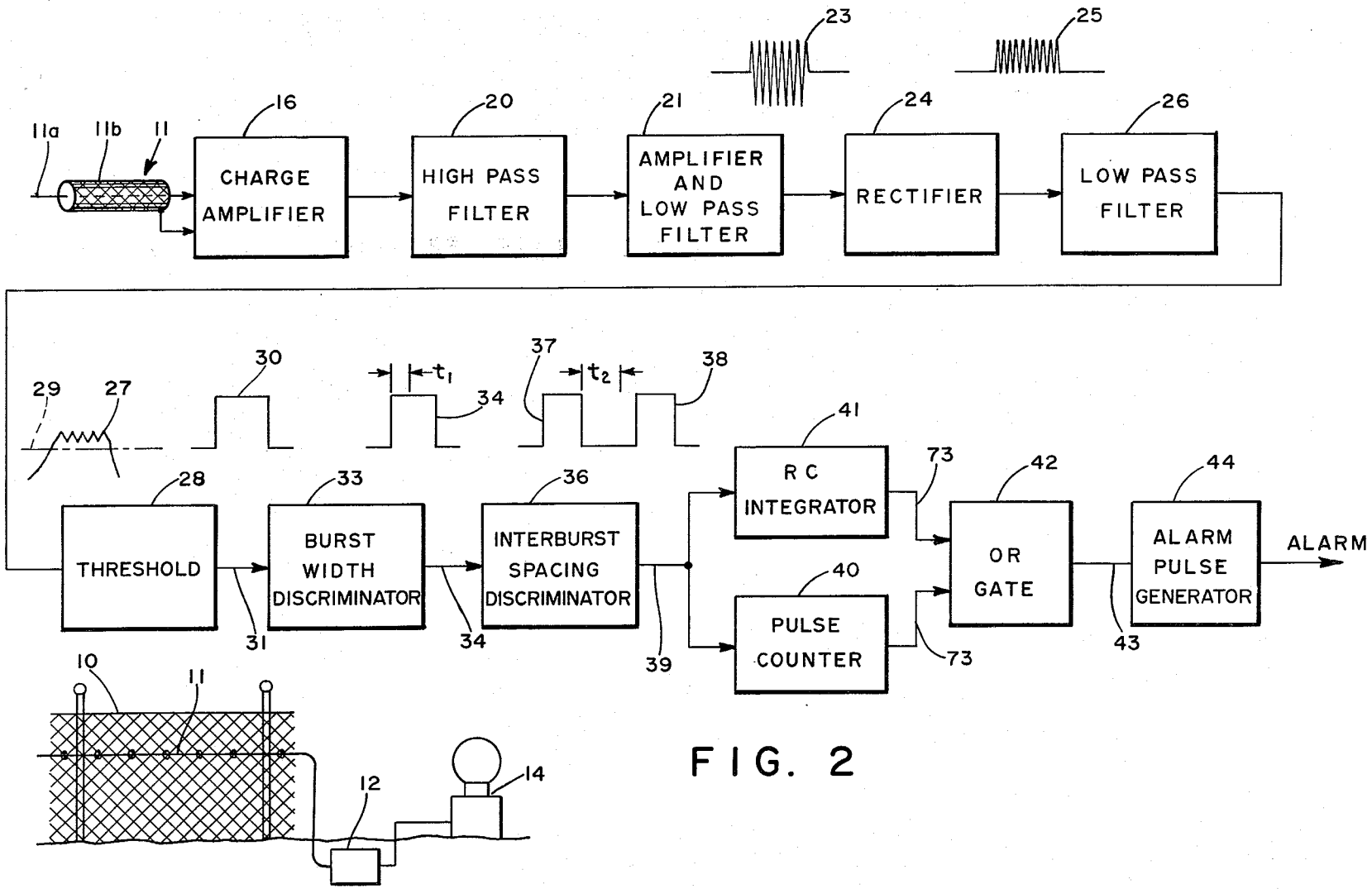
FIG. 1 is a schematic view of a fence protection system embodying the invention.
FIG. 2 is a block diagram of a fence protection processing circuit embodying the invention.

A fence protection system of the type described in U.S. Pat. No. 3,763,482 is shown in FIG. 1 and comprises a fence 10 to which an electret cable 11 is clamped for sensing vibrations generated in the fence. Cable 11 which is a coaxial cable with a dielectric filler that is an electret is connected to processing circuits 12 which may be buried adjacent to the fence and which produce an output in event of an intrusion for actuating alarm apparatus 14 which preferably is located at a remote monitoring station.

Figure 3:
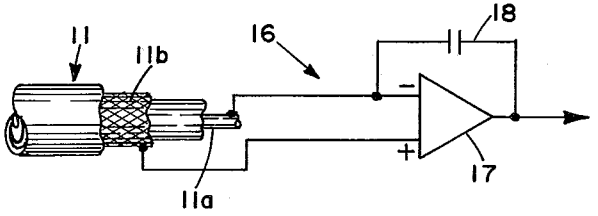
FIG. 3 is a schematic diagram of a charge amplifier forming part of the processing circuit.

Processing circuit 12 is shown in block form in FIG. 2 and comprises a charge amplifier 16 connected directly to the inner conductor 11*a* and outer conductor 11*b* of the coaxial electret cable 11. Charge amplifier 16 comprises an operational amplifier 17, see FIG. 3, having a positive feedback loop 18 connecting the output of the amplifier to its input. The characteristic of the charge amplifier is its extremely low input impedance relative to the impedance of the cable connected to it, viz. a ratio in the order of 0.05 to 1 or less. By way of example, a charge amplifier having an input impedance of 100 ohms would be useful in accordance with this invention with 300 meters of coaxial electret cable having an impedance of 2,000 ohms. In contrast, a typical voltage amplifier for such cable has an input impedance of approximately 40K ohms, or a ratio of 20 to 1.

The improved performance of the charge amplifier compared to a voltage amplifier for a coaxial electret cable transducer will be better understood in the light of the following analysis of the operation of the cable. In one embodiment, 300 meters of a coaxial electret cable having a 16 gauge inner conductor, a woven shield outer conductor and a 10 mil FEP Teflon dielectric is equivalent to a capacitor having a capacitance in the order of 0.075 $\mu$F. The displacement of the outer conductor relative to the inner conductor caused by a vibration in the fence produces a change in capacitance at the point of displacement of approximately 0.01 PF. Thus the change in capacitance ($\Delta C$) due to external force is extremely small compared to the total distributive capacitance of the cable. In order to detect such small change in capacitance in the cable having relatively large capacitance, the amplifier is selected, in accordance with this invention, to have an impedance in the order of 20 to 400 times lower than that of the cable, thus making it extremely responsive to the change in charge (current) in the cable. This sensitivity of the charge amplifier to the transducing action of the cable is such as to make its detecting capability substantially independent of cable length. Thus the same charge amplifier is capable of use with, for example, 30 meters or 300 meters of cable without adjustment of gain and still provides satisfactory results in both cases.

The output of the charge amplifier passes in succession to high pass filter 20 and amplifier and low pass filter 21 which together comprise a bandpass filter having predetermined lower and upper frequency limits. For example, the lower frequency limit of filter 20 may be 550 Hz to reduce or eliminate response to noise generated by wind and to eliminate other unwanted interference such as 60 Hz or 120 Hz pickup. The upper frequency cutoff of filter 21 may fall within the range of 1500 Hz to 4000 Hz, the optimum bandwidth being dependent upon the characteristics of the particular type of cable used as a sensor.

The output of filter 21 is a signal burst indicated at 23. This signal is rectified in rectifier 24 to produce a signal indicated at 25 and thereafter passes through a low pass filter 26 which produces a pulse-like signal 27 that is applied to threshold circuit 28 having a threshold level indicated by broken line 29 on signal 27. Threshold circuit 28 produces an output pulse 30 on line 31 if signal 27 exceeds the threshold level 29 as indicated; there is no output from this circuit if the threshold is not exceeded.

The above-described filters 20, 21 and 26 and rectifier 24, while essential to the operation of the processor embodying my invention, to do per se constitute part of the invention. The same is true of threshold circuit 28.

The output of the threshold circuit on line 31 passes to a brust width discriminator circuit 33 which produces an output signal 34 if the width or duration of the signal exceeds a predetermined minimum, for example $t_1$. Thus circuit 33 blocks pulse having width less than $t_1$. Each raindrop in a normal or heavy rainfall causes a short pulse of less than 10 ms. when it impacts on the fence very near the cable or on the cable directly. The threshold circuit 28 normally eliminates raindrop pulses occurring successively because of their below-threshold amplitude but several raindrops impacting simultaneously can and do produce signals which exceed the threshold. However, I have determined that the raindrop pulse width generally does not exceed 10 ms. even if the pulse signal results from more than one raindrop impacting simultaneously and accordingly burst width discriminator 33 having a minimum width threshold of 10 ms. effectively screens the raindrop-caused signals as well as the class of spurious signals such as random noise spikes and the like.

The output of discriminator 33 passes to an interburst spacing discriminator which passes successive signals as pulses only if the time spacing between successive signals exceeds a predetermined time interval. Thus discriminator 36 passes successive signal bursts 37 and 38 as separate pulses because the interburst spacing exceeds a minimum time indicated as $t_2$. If the interburst spacing is equal to or less than the interval $t_2$, the output of circuit 36 is one continuous pulse. By way of example, time $t_2$ may be in the order of 0.25 sec.

The output of discriminator 36 passes to both a pulse counter 40 and an integrator 41, the outputs from both of which are applied to OR gate 42. Pulse counter 40 produces an output after receiving a predetermined number of pulses within a set time limit. The minimum number of pulses required to produce an output is adjustable and is a measure of selected sensitivity of the system. By way of example, pulse counter 40 may be set to produce an output after three input pulses are applied to it within 120 sec.; if less than the predetermined minimum of pulses is counted within the selected time frame, no output is produced by this circuit.

Signals produced by the dragging of a stick along a chain link fence protected by this type of system are generally continuous and closely spaced. By proper selection of the minimum interburst spacing $t_2$, circuit 36 produces a single continuous pulse in response to such stick dragging and pulse counter 48 therefore does not produce an output to the OR gate 42. Thus in accordance with this invention, false alarms from such stick dragging activity are minimized or eliminated.

In order to protect against the possibility of the use of stick dragging on the fence to mask a genuine intrusion attempt as by climbing or cutting the fence while dragging a stick on it, integrator circuit 41 is provided to produce an output to the OR gate if a continuous imput signal persists greater than a predetermined time such as 8 seconds. Integrator 41 comprises an RC network accumulates charge on a capacitor in the presence of a continuous signal until a threshold is exceeded and thereupon produces an output to the OR gate. The selection of the time constant for integrator 41 and the number of pulses required by counter 40 to produce an output to the OR gate is determined by a compromise of system sensitivity to provide maximum intrusion detection capability with a minimum false alarm rate.

The output of OR gate 42 on line 43 produced by an input from either counter 40 or integrator 42 is applied to an alarm pulse generator 44 which produces an output that activates alarm apparatus 14 such as a bell, flashing light or the like.

Figure 4:
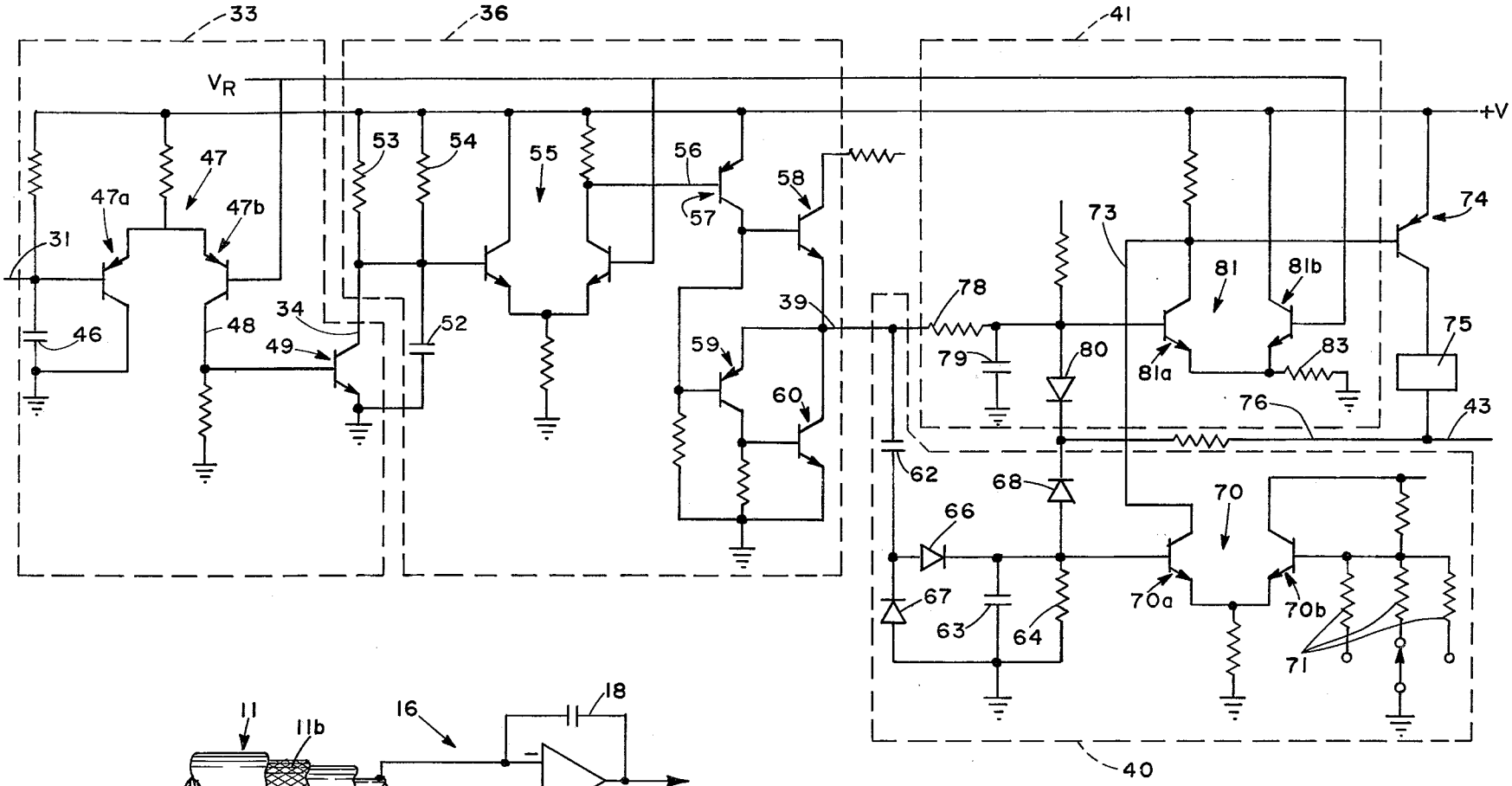
FIG. 4 is a schematic diagram of signal discriminating circuits forming part of the processor for the fence protection system.

Referring now to FIG. 4, the circuit diagram for discriminators 33 and 36, pulse counter 40 and integrator 41, all enclosed in broken line outlines, and OR gate 42 is shown. Burst width discriminator 33 comprises a capacitor 46 connected across the input of the first transistor stage 47*a* of differential amplifier 47 and to which the output line 31 from threshold circuit 28 is connected. The output of the second transistor stage 47*b* of amplifier 47 on line 48 is connected to the base of transistor 49, the output of which is taken at the collector lead which becomes output line 34. Transistor 47*a* is normally on (conducting) while transistor 47*b* is normally off (nonconducting).

In operation, an output pulse on line 31 from threshold circuit 28 causes capacitor 46 to charge as long as the pulse persists; when that capacitor charge reaches a predetermined level after a time interval corresponding to a minimum width for passable pulses, transistor 47*a* is biased off, transistor 47*a* is turned on and transistor 49 is turned on causing the voltage at lead 34 to drop from a high to a low level. If the input pulse on line 31 to capacitor 46 is shorter than the foregoing predetermined minimum width, capacitor 46 does not charge up sufficiently to turn transistor 47*a* off and there is no output from this discriminator circuit on line 34.

Interburst spacing discriminator 36 has a capacitor 52 which is charged through resistors 53 and 54 and remains in a charged state in the absence of an output on line 34 from burst width discriminator circuit 33. The charge on capacitor 52 controls the operation of differential amplifier 55 the output of which on line 56 controls the operation of transistor 57; the output of transistor 57 controls the operation of transistors 58, 59 and 60 such that the voltage at output line 39 of discriminator 36 changes between low level and high level voltage states when input pulses are passed through this circuit.

The spacing or time interval between successive input pulses to capacitor 52 on line 34 must exceed a predetermined minimum before the output on line 39 can return from the high level to the original low level. This is effected by the charging rate of capacitor 52 through resistors 53 and 54. Upon passage of one pulse through the circuit, which discharges capacitor 52, the latter charges through resistors 53 and 54 at a rate determined by the RC time constant. If the next pulse occurs before the capacitor is fully charged, amplifier 55 is inoperative to pass the second pulse and the capacitor is again discharged to begin its charging cycle again. Thus a succession of too closely spaced input pulses results in but one output pulse on line 39. The RC time constant is selected to be greater than the period between impacts of a stick against a chain link fence as it is dragged therealong at a normal rate so as to discriminate against this type of nuisance activity.

The output from discriminator 36 on line 39 is connected to counting capacitor 62 in counter 40 which in turn is connected across summing capacitor 63 and resistor 64 through coupling diodes 66 and 67. Capacitor 63 is connected to reset diode 68 and to the first stage 70*a* of differential amplifier or comparator 70. The second stage 70*b* of comparator 70 is biased by resistors 71 which determines the threshold at which capacitor 63 discharges. By selection of the values of these resistors the number of pulses required to produce an output from counter 40 is determined. The discharge rate of capacitor 63 through resistor 64 determines the frequency of pulses required to produce an output from the counter.

The first stage 70*a* of comparator 70 is connected by line 73 to a switching transistor 74 which operates a switch 75 connected via line 76 to reset diode 68. When comparator stage 70*a* becomes operative, i.e., changes operating states upon the charge on capacitor 63 exceeding the threshold set by resistors 71, transistor 74 is actuated to cause switch 75 to open diode 68 to reset capacitor 63.

Integrator 41 comprises a resistor 78 and capacitor 79 connected to reset diode 80 and to a comparator 81 having a first stage 81*a* connected via line 73 to switching transistor 74. The bias on the second stage 81*b* of comparator 81 is set by reference voltage $V_R$. When the input pulses from circuit 36 charge capacitor 79 to a value which causes stage 81*a* of comparator 81 to change states, transistor 74 activates switch 75 to reverse bias diode 80 and thus discharge capacitor 79 and reset the integrator.

The common connection of comparator stages 70*a* and 81*a* by line 73 performs the function of OR gate 42.

What is claimed is:

1. A signal processor for a fence protection system having an elongated transducer coupled to the fence and adapted to produce an electrical signal output comprising a succession of signal bursts in response to vibrations induced in the fence, said processor comprising means responsive to the output of said transducer for passing as separate bursts successive bursts having an interburst time spacing greater than a predetermined interval, and passing as a single burst successive bursts having other interburst spacings.

means for counting said passed bursts and producing an output after counting a predetermined number of bursts within a preset time interval, and alarm means responsive to the output of said counting means for producing an alarm.

2. A processor according to claim 1 with timing means responsive to the output of said first named means for producing an output when the duration of a single burst exceeds a predetermined time limit, said alarm means also being responsive to the output from said timing means.

3. A processor according to claim 1 with means responsive to the output of said interburst circuit for integrating said passed bursts and producing an output when the duration of a single signal is greater than a predetermined limit, said alarm means also being responsive to said output of said integrating means.

4. A fence protection system comprising a transducer cable with a characteristic impedance and having an outer conductor and an inner conductor and a dielectric filler therebetween, said filler comprising an electret, means for coupling said cable to said fence whereby vibrations induced in the fence are coupled to said cable for producing electrical signals across the conductors of said cable.

a charge amplifier connected across said conductors whereby to detect said signals, said amplifier having an input impedance 20 to 400 times lower than said cable impedance, and circuit means responsive to the output of said charge amplifier for discrininating against unwanted signals and indicating an alarm in response to other signals.

5. A fence protection system comprising an electret cable with a characteristic impedance and having an outer conductor and an inner conductor and a dielectric filler therebetween, said filler comprising an electret, means for coupling said cable to said fence whereby vibrations induced in the fence are coupled to said cable for producing electrical signals across the conductors, a charge amplifier connected across said conductors whereby to detect said signals, said amplifier having an input impedance substantially lower than said cable impedance, circuit means responsive to the output of said charge amplifier for discriminating against unwanted signals and indicating an alarm in response to other signals.

6. The system according to claim 5 in which said circuit means comprises an integrator circuit also responsive to the output of said interburst circuit, said integrator circuit having a threshold which is exceeded when the duration of said single signal is greater than a predetermined limit whereby to produce an alarm generating output from said integrator circuit.

7. A fence protection system comprising an elongated coaxial cable having an inner conductor and an outer conductor and a dielectric filler therebetween. said filler comprising an electret means for clamping said cable to the protected fence throughout its length whereby vibrations of the fence are coupled to the cable and generate across said conductors an electrical signal in the form of a succession of bursts, a charge amplifier having an input connected across said conductors for detecting said signal and producing an output, filter and rectifier circuit means connected to the output of said charge amplifier and passing only signal bursts having a frequency in a predetermined passband, threshold circuit means responsive to the output from said filter and rectifier circuit means and operative to produce an output only when said bursts have an amplitude that exceeds a predetermined threshold, a burst width discriminator responsive to said output from the threshold circuit means and passing bursts as an output only when the time duration of each burst exceeds a predetermined value whereby to block narrow width bursts, said discriminator comprising a charging capacitor a differential amplifier having an input connected to said capacitor and having a predetermined operational bias voltage controlled by the charge voltage on said capacitor whereby the amplifier transmits the signal burst when said charge voltage exceeds said bias voltage, an interburst spacing discriminator responsive to the output of said burst width discriminator and operative to pass successive signal bursts separately only if the time interval between successive bursts exceeds a predetermined time limit, said interburst spacing discriminator comprising a normally charged capacitor adapted to be discharged upon receipt of a signal burst, and differental amplifier means connected to said charged capacitor and adapted to change operating states after said capacitor is recharged from the discharged condition, pulse counter means responsive to the output from said interburst spacing discriminator and adapted to produce an output after receipt of a predetermined number of signal bursts, integrator circuit means responsive to the output of said interburst spacing discriminator for producing an output in response to a continuous signal input having a duration in excess of a predetermined limit, and alarm means responsive to the outputs of said pulse counter means and said integrator circuit means for producing an alarm.

8. A fence protection system comprising an electret cable having an outer conductor and an inner conductor and a dielectric filler therebetween, said filler comprising an electret, means for coupling said cable to said fence whereby vibrations induced in the fence are coupled to said cable for producing an electrical signal output from said cable, a charge amplifier having an input connected across said inner and outer conductors and producing an output in response to a change in the electrical charge on the cable induced by said vibrations, processor means connected to said charge amplifier for discriminating against spurious signals comprising envelope detector and rectifier means receiving the output of said charge amplifier and producing a series of pulses corresponding to said vibrations, threshold means responsive to the output of said detector and rectifier means for passing only those pulses having an amplitude greater than a predetermined threshold level, burst width discriminator means responsive to the output of said threshold means for passing only those pulses having a width greater than a predetermined minimum whereby to block short width pulses, interburst spacing discriminator means connected in series with said burst width discriminator means and having timing circuit means for passing as separate bursts successive bursts having greater than a predetermined interburst spacing and passing as a single burst successive burst having interburst spacing no greater than said predetermined spacing, pulse counter means responsive to the outputs of said burst width discriminator means and said interburst spacing discriminator means and producing an output upon receipt of a predetermined number of pulses within a predetermined time, and alarm means responsive to the output of said counter means for indicating an alarm state.

9. The system according to claim 8 having an integrator circuit having an input connected in parallel with the input of said counter means, said integrator circuit being responsive to a continuous output signal from said interburst spacing discriminator means and producing an output when the time interval of said continuous signal output exceeds a predetermined value, said alarm means also being responsive to the output of said integrator circuit.

* * * * *

UNITED STATES PATENT OFFICE

CERTIFICATE OF CORRECTION

PATENT NO. : 3,947,835

DATED : March 30, 1976

INVENTOR(S) : Marvin D. Laymon

It is certified that error appears in the above-identified patent and that said Letters Patent are hereby corrected as shown below:

Column 3, line 15, after "the" insert --charge or--.
Column 3, line 50, delete "brust" and insert --burst--.

Column 5, line 2, change "47a" to --47b--.
Column 6, claim 5, line 68, change period to comma and add:

--said circuit means comprising an interburst discriminator circuit having timing means responsive to the time interval between successive signals and operative to pass same as a single signal when said interval is less than a predetermined limit, and a counter circuit responsive to the output of said interburst circuit, said counter circuit having signal counting means with a threshold corresponding to a predetermined number of signals and adapted to produce an output only when said threshold is exceeded.--.

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*